US006712328B1

(12) United States Patent
Morton

(10) Patent No.: US 6,712,328 B1
(45) Date of Patent: Mar. 30, 2004

(54) ROTATABLE EASEL

(76) Inventor: Richard Joseph Morton, 4 Central Ave., Sausalito, CA (US) 94965

( * ) Notice: Subject to any disclaimer, the term of this patent is extended or adjusted under 35 U.S.C. 154(b) by 0 days.

(21) Appl. No.: 10/215,842

(22) Filed: Aug. 8, 2002

(51) Int. Cl.[7] ..... A47B 97/04
(52) U.S. Cl. ..... 248/458
(58) Field of Search ..... 248/448, 460, 248/458, 441.1, 286.1, 285.1

(56) References Cited

U.S. PATENT DOCUMENTS 3,140,558 A * 7/1964 Cassidy ..... 248/449
3,926,398 A * 12/1975 Vincent ..... 248/448
4,134,614 A * 1/1979 Fielding, Sr. ..... 297/158
4,154,173 A * 5/1979 Chesnut ..... 108/6
5,074,513 A * 12/1991 Presley et al. ..... 248/454
5,161,766 A * 11/1992 Arima ..... 248/447
5,193,772 A * 3/1993 Johnston ..... 248/118.5
5,624,097 A * 4/1997 Potter ..... 248/464
5,725,192 A * 3/1998 Cloninger ..... 248/458
6,390,433 B1 * 5/2002 Kasa-Djukic ..... 248/441.1

* cited by examiner

*Primary Examiner*—Ramon O. Ramirez
*Assistant Examiner*—Kofi Schulterbrandt
(74) *Attorney, Agent, or Firm*—Risto A. Rinne, Jr.

(57) ABSTRACT

An apparatus for the display and presentation of materials, such as an artist's painting or other presentation material, has a first planar member that is pivotally attached to a second planar member and adapted to rotate at least ninety degrees about an axis passing therethrough from a first, landscape orientation into a second, portrait orientation. A lip is attached to the second planar member for supporting the material. A third planar member is hingedly attached to the second planar member and is adapted to pivot about a hinge in an arc. A cord and retainer limits the maximum amount of pivot of the third planar member away from the second planar member.

17 Claims, 3 Drawing Sheets

ROTATABLE EASEL

BACKGROUND OF THE INVENTION

1. Field of the Invention

The present invention, in general relates to artist and presentation supplies and, more particularly, to easels.

Easels are well known devices used by artists to hold a canvas, or the like, during formation of the artwork. They can also be used during presentations to hold materials for viewing. There is, however, a problem that previous types of easels experience.

That problem relates to the orientation of the easel during use, whether it is disposed in a horizontal or "landscape" orientation or vertically in a "portrait" orientation.

Whether the easel is used to hold a canvas or to display an item for viewing, either orientation may be preferred.

Accordingly there exists today a need for a rotatable easel that can readily adjust for either vertical or horizontal display of a canvas or presentation material.

Clearly, such an apparatus would be useful and desirable.

2. Description of Prior Art

Easels are, in general, known. For example, the following patents describe various types of these devices:

U.S. Pat. No. 937,671 to Borgzinner,

U.S. Pat. No. 2,127,494 to Tepper, and

U.S. Pat. No. 6,231,023 to Morton, the same inventor.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide rotatable easel that is easy to transport.

It is also an important object of the invention to provide rotatable easel that is light in weight.

Another object of the invention is to provide rotatable easel that folds thin for transport.

Still another object of the invention is to provide rotatable easel that includes a first planar member adapted for holding a canvas that is adjustable in its angle of presentation with respect to a user.

Still yet another object of the invention is to provide rotatable easel that includes a first planar member that is pivotable about a normal axis with respect to a second planar member.

Yet another important object of the invention is to provide rotatable easel that allows a first planar member to rotate about an axis that is normal to the plane of the first member at least 90 degrees.

A still further object of the invention is to provide rotatable easel that is adapted to support a material such as an artist canvas or a display material in either a portrait or a landscape orientation.

Briefly, rotatable easel that is constructed in accordance with the principles of the present invention has a first planar member that is adapted to rotate at least ninety degrees from a first position into a second position about an axis with respect to a second planar member. A lip is attached to a bottom end of the second planar member. A third planar member is hingedly attached to the second planar member and is secured in position by an adjustable length cord that passes through holes provided in the first and second planar member, the lip, and the third planar member.

DETAILED DESCRIPTION OF THE INVENTION

Figure 1:
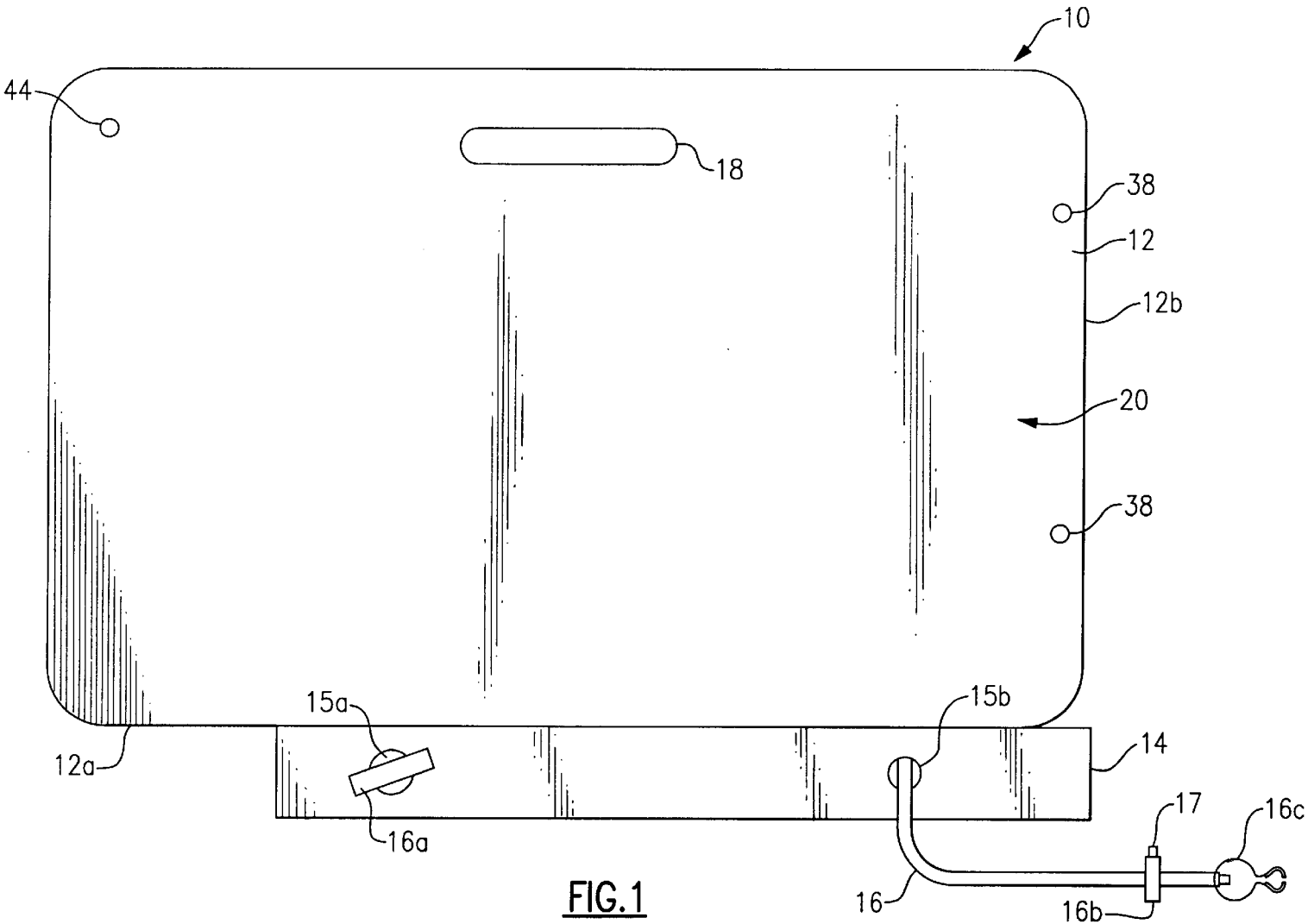
FIG. 1 is a front plan view of a rotatable easel with the easel in a first horizontal position.

Referring to all of the drawings and in particular to FIG. 1 is shown, a rotatable easel, identified in general by the reference numeral 10.

A first planar member 12 provides a support for a canvas (not shown) that rests on a lower lip 14. The lip 14 extends out and away from the surface of the first planar member 12 sufficient to provide a ridge upon which the canvas can be supported on an edge thereof.

A cord 16 begins at a first retainer 16a, passes through a pair of holes 15*a*, 15*b* in the lip 14 of the easel 10, exits from the front, includes a second retainer 16*b* and terminates in a hook 16*c*. The use of the cord 16 is described in greater detail hereinafter.

The first planar member 12 includes a hand-hold slot 18 that is useful for carrying the easel 10. The slot 18 is offset from a centerline to aid in carrying the easel 10. The offset of the hand-hold slot 18 aligns with a center of gravity of the easel 10, and is described in greater detail hereinafter.

The first planar member 12 may include a smooth surface, as shown in general by the reference numeral 20, applied to one side thereof that is adapted to receive an image (not shown) applied thereto. The smooth surface 20 allows writing directly on the surface 20, for example with erasable marking pens (not shown). This is useful for presentation purposes.

A second planar member 22 is attached at one end thereof to the lip 14. The second planar member 22 is always parallel to the first planar member 12.

The second planar member 22 includes a mounting slot 24 that includes a longer length than width.

A circular spacer 26 is attached to the first planar member 12 and is disposed within the mounting slot 24. Accordingly, the diameter of the circular spacer 26 must not exceed the width of the mounting slot 24.

A circular retaining ring 28 is disposed over the circular spacer and is attached thereto. The retaining ring 28 is a substantially planar circular member. The retaining ring 28 must include a diameter that is greater than the width of the mounting slot 24.

Any method of attachment of any of the component parts of the easel 10 are possible that preserve its functioning. A possible method of attachment is to adhere the circular spacer 26 to the back of the first planar member 12 (i.e., opposite the smooth surface 20 side) and to then adhere the retaining ring 28 to the circular spacer 26.

Accordingly, the first planar member 12 is adapted to rotate about an axis 30 (identified by a dot) that is normal with respect to the first planar member 12 and the second planar member 22.

The axis 30 is disposed in the mounting slot 24 at a distal location with respect to the lip 14, recessed only from the most distal end of the mounting slot 24 by an amount equal to the radius of the circular spacer 26.

As shown in FIG. 1, a first edge 12*a* of the first planar member 12 is in contact with the lip 14. This position is a first position of the first planar member 12 and it is generally referred to as a horizontal or landscape orientation.

The first planar member 12 includes a second edge 12*b* that is perpendicular with respect to the first edge 12*a*. As the first edge 12*a* is longer than the second edge 12*b*, the first planar member 12 includes a width that is less than a length.

To rotate the first planar member 12 with respect to the second planar member 22, the first planar member 12 is pulled up so as to displace the first edge 12*a* (and the circular spacer 26 and the retaining ring 28) maximally away from the lip 14.

In this position, the first planar member 12 is free to pivot about the axis 30 at least ninety degrees with respect to the second planar member 22 as shown by arrow 31. Because the second planar member 22 is attached to the lip 14, the first planar member 12 also rotates ninety degrees with respect to the lip 14.

Figure 3:
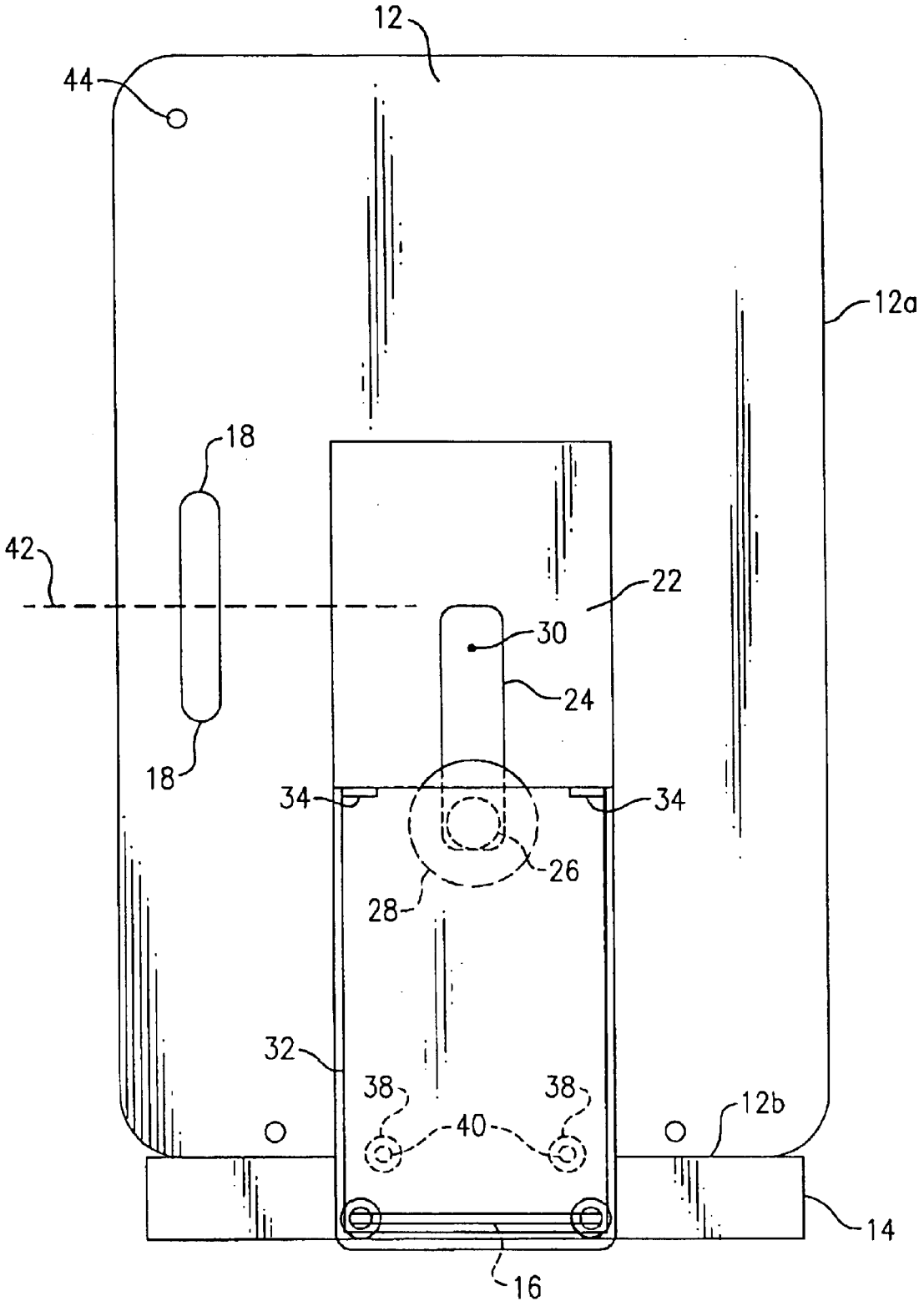
FIG. 3 is rear plan view of the easel of FIG. 1 with the easel rotated ninety degrees into a second vertical orientation.

The first planar member 12 is then lowered in the mounting slot 24 until the second edge 12*b* makes contact with the lip 14. Accordingly, the first planar member 12 has been rotated ninety degrees to a vertical or portrait position, as shown in FIG. 3. It is not necessary for the first planar member 12 to rotate more than ninety degrees, although it certainly is possible to modify the design to achieve a greater amount of rotation, if that is desired.

The pair of holes 15*a*, 15*b* that pass through the lip 14 also extend and pass through the second planar member 22.

Figure 2:
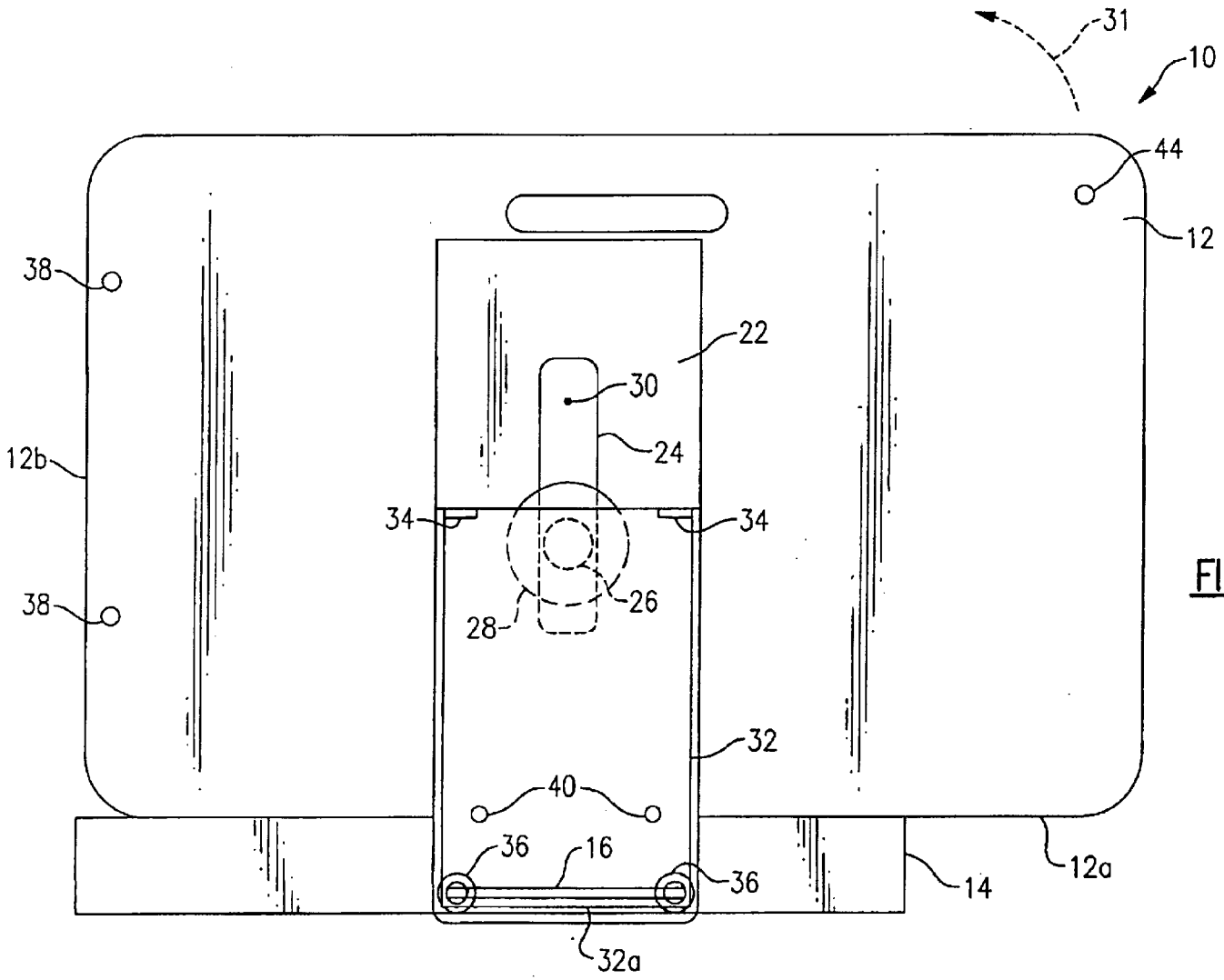
FIG. 2 is a rear plan view of the easel of FIG. 1.

A third planar member 32 (shown in dashed lines, FIGS. 2 and 3) is hingedly attached to the second planar member 22 proximate the mid-point of the second planar member 22 by a pair of hinges 34. Sufficient clearance is provided under the third planar member 32 to allow for passage of the retaining ring 28.

A lower edge 32*a* of the third planar member 32 is adapted to pivot away from the second planar member 22.

The pair of holes 15*a*, 15*b* that pass through the lip 14 also extend and pass through the third planar member 32, however a pair of friction reducing rings 36 are inserted through the pair of holes 15*a*, 15*b* in the openings that pass through the third planar member 32.

The cord 16 loops in through the first of the pair of holes 15*a*, passes around the back of the third planar member 32, and then passes out the second of the pair of holes 15*b* to the front of the easel 10. The friction reducing rings 36 help reduce the force that is required to pull the cord 16, especially when the easel 10 is in use and there is a weight (i.e., of the canvas) disposed on it.

If the second retainer 16*b* is loosened and moved closer toward the hook 16*c*, then the third planar member 32 can be pivoted further away from the second planar member 22. In this position, the first planar member 12 is tilted back to the extend that is desired and once the preferred position for using the easel 10 is achieved, this position is maintained by displacing (i.e., moving) the second retainer 16*b* until contact is made with the first planar member 12.

The second retainer 16*b* includes a push button 17 that is depressed to permit moving the second retainer 16*b* along the length of the cord 16. When the button 17 is released, the second retainer 16*b* stays in place on the cord 16.

If the hook 16*c* end of the cord 16 is drawn from the easel 10, the bottom of the third planar member 32 is pulled (i.e., pivoted) toward the second planar member 22 until it is in contact with it. The second retainer 16*b* is then moved until it again contacts the first planar member 12 thereby securing the third planar member 32 against the second planar member 22. This position is used for transit of the easel 10 as the easel 10 is flat and highly portable in this position.

To aid in securing the first planar member 12 during transport, a pair of transport holes 38 are provided proximate the second edge 12*b* of the first planar member 12 and also through the second planar member 22 in alignment with that of the first planar member 12 when the first planar member 12 is disposed in the second vertical position.

A pair of pins 40 are included in the third planar member 32 on the side thereof that faces the second planar member 22. The pins 40 protrude from the third planar member 32, pass through the transport holes 38 in the second planar member 22 and the transport holes 38 in the first planar member 12.

When the cord 16 is drawn tight, the pins 40 prevent rotational movement of the first planar member 12 as well as any longitudinal movement of the first planar member 12 within the mounting slot 24, thereby making the easel 10 secure for movement when it is disposed in the second vertical position.

A centerline 42 through the hand-hold slot 18 aligns with a center of gravity of the easel in this position, thereby making it even easier to carry.

When the cord 16 is secured in the transport position, the hook 16*c* can be used to secure the end of the cord 16 where desired. For example, the cord 16 can be passed through the hand-hold slot 18 and the hook 16*c* can be clasped around the cord 16 thereby securing the cord in position around the hand-hold slot 18. The cord 16 can then be draped over a shoulder (not shown) to aid in portage of the easel 10. Alternatively, a corner hole 44 is provided through the first planar member 12 and the hook 16*c* is attached to the corner hole 44 prior to draping the cord 16 over the shoulder.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A rotatable easel, comprising:

(a) a first planar member that is substantially rectangular in shape having a predetermined length, width, and thickness;

(b) a second planar member that includes a predetermined length and width; and (c) means adapted for rotating said first planar member about an axis with respect to said second planar member, said axis being normal to said first planar member and to said second planar member;

and wherein said means adapted for rotating said first planar member about an axis with respect to said second planar member includes providing a mounting slot in said second planar member, said mounting slot having a length that is greater than a width, and including a circular ring that is attached on a first side thereof to said first planar member and wherein said circular ring is adapted to be disposed in said mounting slot and including a retaining ring that is attached to an opposite side of said circular ring and wherein said retaining ring includes a diameter that exceeds the width of said mounting slot and wherein said retaining ring secures said second planar member proximate to said first planar member and in parallel planar alignment with respect to said first planar member.

2. The easel of claim 1 including a lip adapted for receiving an object thereon, said lip attached to said second planar member.

3. The easel of claim 1 wherein said first planar member is adapted to rotate about said axis at least ninety degrees.

4. The easel of claim 3 wherein said first planar member is adapted to rotate ninety degrees from a first position into a second position.

5. The easel of claim 4 wherein said first position includes a landscape orientation and wherein said second position includes a portrait position.

6. The easel of claim 1 including means for carrying said easel.

7. The easel of claim 6 wherein said means for carrying includes a hand-hold slot disposed in said first planar member.

8. The easel of claim 1 including a third planar member hingedly attached to said second planar member, said third planar member adapted to pivot about said an axis passing through a hinge wherein a bottom portion of said third planar member is adapted to be displaced in an arc away from said second planar member.

9. The easel of claim 8 including means for retaining said bottom portion of said third planar member a selected distance away from said second planar member.

10. The easel of claim 9 wherein said means for retaining said bottom portion of said third planar member includes a cord passing through a pair of holes through said lip, said second planar member, and said third planar member, and wherein said cord includes means for adjusting a length thereof sufficient to retain said bottom portion of said third planar member in position.

11. The easel of claim 10 wherein said third planar member includes means for reducing friction intermediate said cord and said pair of holes in said third planar member.

12. The easel of claim 11 wherein said means for reducing friction includes a pair of grommets disposed in said pair of holes in said third planar member.

13. The easel of claim 10 wherein said cord includes a first end that is fixed relative to said first planar member and an opposite second end, and wherein said second end includes a hook, said hook adapted for securing said second end of said cord to said easel.

14. The easel of claim 1 including means for preventing said first planar member from rotating when said easel is adapted for transport.

15. The easel of claim 14 wherein said means for preventing said first planar member from rotating includes providing means for engaging said third planar member with said first planar member sufficient to retain said first planar member in position with respect to said third planar member.

16. The easel of claim 15 including at least one pin in said third planar member that is adapted to engage with at least one transport hole provided in said first planar member when said third planar member is disposed in substantially parallel planar alignment with respect to said first planar member.

17. A method for providing a rotatable easel, comprising the steps of:

(a) providing a first planar member that is substantially rectangular in shape and having a predetermined length, width, and thickness;

(b) providing a second member; and (c) providing means for rotating said first planar member about an axis with respect to said second member, said axis being normal to said first planar member and to said second planar member;

and wherein the step of providing means adapted for rotating said first planar member about an axis with respect to said second planar member includes providing a mounting slot in said second planar member, said mounting slot having a length that is greater than a width, and including a circular ring that is attached on a first side thereof to said first planar member and wherein said circular ring is adapted to be disposed in said mounting slot and including a retaining ring that is attached to an opposite side of said circular ring and wherein said retaining ring includes a diameter that exceeds the width of said mounting slot and wherein said retaining ring secures said second planar member proximate to said first planar member and in parallel planar alignment with respect to said first planar member.

* * * * *